US006855373B2

(12) United States Patent
Karlsson

(10) Patent No.: US 6,855,373 B2
(45) Date of Patent: Feb. 15, 2005

(54) METHOD AND DEVICE RELATING TO COATING A RUNNING WEB

(75) Inventor: Håkan Karlsson, Säffle (SE)

(73) Assignee: BTG Pulp and Paper Technology Aktiebolag, Saffle (SE)

( * ) Notice: Subject to any disclaimer, the term of this patent is extended or adjusted under 35 U.S.C. 154(b) by 0 days.

(21) Appl. No.: 10/168,076

(22) PCT Filed: Dec. 4, 2000

(86) PCT No.: PCT/SE00/02416

§ 371 (c)(1),
(2), (4) Date: Jul. 23, 2002

(87) PCT Pub. No.: WO01/43885

PCT Pub. Date: Jun. 21, 2001

(65) Prior Publication Data

US 2003/0104130 A1 Jun. 5, 2003

(30) Foreign Application Priority Data

Dec. 15, 1999 (SE) ..... 9904586

(51) Int. Cl.[7] ..... B05D 3/12
(52) U.S. Cl. ..... 427/348; 427/286

(58) Field of Search ..... 427/286, 348; 118/62, 63, 68

(56) References Cited

U.S. PATENT DOCUMENTS 3,865,298 A * 2/1975 Allen et al. ..... 118/63
4,416,919 A * 11/1983 Beck ..... 427/296

FOREIGN PATENT DOCUMENTS

| | | | | |
|---|---|---|---|---|
| DE | 3210388 A1 | | 10/1983 | |
| DE | 19643353 A1 | | 4/1998 | |
| JP | 08-24935 A | * | 1/1996 | ..... B21B/45/02 |
| JP | 11276981 | | 10/1999 | |
| SE | C2 503 836 | | 6/1996 | |
| WO | WO 98/53112 A | * | 11/1998 | |

* cited by examiner

*Primary Examiner*—Shrive P. Beck
*Assistant Examiner*—David Turocy
(74) *Attorney, Agent, or Firm*—Nixon & Vanderhye

(57) ABSTRACT

When a running web (3) is coated with a liquid coating mixture, at least one side of the web is provided with a coating (40, 40') of coating mixture. Existing excess (33) of coating mixture in or adjacent to the regions of the edge portions of the web is removed by being blown off downstreams of where the coating operation is performed.

8 Claims, 4 Drawing Sheets

METHOD AND DEVICE RELATING TO COATING A RUNNING WEB

TECHNICAL FIELD

The invention relates to a method for coating a running web with liquid coating mixture, so that at least one side of the web is provided with a coating of a coating mixture. The invention also relates to a device for carrying out the method. The web preferably is a web which completely or partly consists of a cellulose-containing material, e.g. a paper web or a paper board web.

BACKGROUND OF THE INVENTION

Doctor blade coating is a coating method where a web, e.g. a web of paper, paper board or other cellulose-containing material, which contacts a support member, e.g. a roll, is supplied with a coating mixture in excess in a first step. The coating mixture may have the form of a more or less viscous liquid, usually referred to as coating paste. In this text, however, the term coating mixture is used. In the next step, excess of coating mixture is scraped off and the coating layer is evened by means of a so called coating blade. According to conventional technique the coating blade consists of a resilient steel blade. The Swedish patent No. 507 926, however, discloses a technique employing a blade which has a soft coating, which contacts the web. The present invention in the first place is intended to be used in connection with any of these two blade types.

When a paper web shall be coated by means of a blade only on one side according to conventional technique, wherein conventional steel blades as well as steel blades having a soft contact surface can be used, the coating usually is not accomplished all the way out to the side edges of the web, but about 10 to 20 mm wide edge zones are left uncoated at the two edges. The reason for this is that if the coating would be performed right to the side edges, coating mixture would be applied also on the edge surfaces, which are more or less uneven and often not quite straight. As a matter of fact, a more plentiful amount of coating mixture in this case would be applied on the edges than on the surface of the web intended to be coated. The coating mixture which is applied on the edge surfaces also, when only one surface is being coated, partly passes over to the opposite, uncoated side of the web, and since this side has contact with rolls as the web is transported in the coating machine before the coating mixture has dried to its so called point of immobilisation (i.e. to tack-free state), coating mixture will deposit on said rolls, which gives rise to problems concerning operation and quality.

The technique to avoid coating the web right out to the side edges, when only one side is being coated, implies that said problems are avoided. However, a drawback with that technique is that the web material is not fully utilized because uncoated edge zones must be cut off. Another drawback is that the edge zones are not supplied with the same amount of liquid as the coated region, which poses a risk of tensions in the edge zones and at worse ruptures in the edge regions.

Another problem is that the end portions of the coater blade is subjected to more severe wear, i.e. the portions which correspond to the border zones between the coated surface and the uncoated edge portions of the web. The reason for this is that the coating mixture, which normally consists of pigment and binding agents dispersed in water, is depleted of liquid in the above mentioned border zones. This is considered to depend on the fact that the web surface, which consists of fibre material, absorbs liquid and that there is a possibility for the liquid in the border zones to be absorbed outwards towards the dry edge portions. Therefore, more liquid is absorbed in the border zones than in the region of the coated surface inside of the edge, which leads to the formation of border zones containing dryer coating mixture and therefore more severe wear. The greater wear in the said zone in the course with time will result in a thicker deposition of coating mixture in the border zones, i.e. excess of coating mixture in those zones which do not get ample time to dry to the point of immobilisation of the coating mixture before it contacts rolls, which also gives rise to problems because of depositions on drying cylinders and guide rolls.

According to another method, both sides are coated simultaneously, as the web is guided between blades facing one another as is disclosed in the Swedish patent No. 507 926. According to that method, the web either can be guided vertically upwards or vertically downwards. The web normally is coated right out to the edges. Subsequent to the coating station the web is guided without being touched through the drying section so far that the layer of coating mixture, referred to as the paste layer by professional men, has dried to a tack-free dry content level.

Also in that case, more liquid in the form of coating mixture is absorbed by the web edges than by the web surfaces, which may cause that the edges have not reached a tack-free dry content level when the web is brought into contact with web guiding rolls or drying cylinders.

BRIEF DISCLOSURE OF THE INVENTION

The present invention aims at addressing the above complex of problem in connection with coating a web material. More particularly, the invention aims at removing the excess of coating mixture in or adjacent to the regions of the edge portions of the web.

In a preferred embodiment it is a purpose of the invention to eliminate the above mentioned problems in connection with coating the whole width of a web material, i.e. right out to the edges.

Still another purpose of the invention is to make coating of the entire web possible, not only in connection with double-sided coating, but also in connection with single-sided coating.

Preferably, it is also a purpose of the invention to eliminate or at least to reduce the above mentioned problems caused by blade wear in connection with non-entire width coating.

These and other objectives can be achieved therein that the existing excess of coating mixture in or adjacent to the regions of the edge portions of the web is removed by being blown off. More particularly, the said excess of coating mixture in the region of each of the edge portions of the web is removed by means of compressed-air in the form of one or more compressed-air jets, while the coating mixture still is in a liquid state. By preheating the compressed-air it is also possible to achieve an improved evaporation of the coating mixture, which further ensures that the coating mixture in the edge portions has reached its point of immobilisation before it is brought in contact with any rolls.

Suitably, compressed-air jets are directed against the two edge portions of the web on both sides of the web. Preferably, that mode is performed in the case of double-sided as well as in the case of single-sided coating, and most conveniently the devices and the blowing performance are carried out such that symmetry is created in the edge portions as far as the performance of the blowing is concerned.

In other respects, the blowing can be performed in various modes, but suitably the compressed-air jet or the compressed-air jets are directed at an acute angle in relation to the surface of the web and out towards the edge of the web from a position inside the edge of the web.

In the case when the invention is employed for removing excess of coating mixture in the form of thicker strands of deposited coating mixture caused by a heavier blade wear in the region of said border zones, the compressed-air jets are directed such that they hit said strands, so that the excess of coating mixture in said strands are removed and/or so that the mixture is evened, i.e. so that the strands are partly distributed out towards the dry edge portions and partly are blown off. In those cases, when it is the matter of coating the entire width of the web, and the excess of coating mixture is concentrated to the outermost edges of the web, the compressed-air jets are directed further out towards those edges in order to blow off the excess of coating mixture.

The device of the invention comprises a blow-off unit located downstreams of the equipment, where the coating mixture is applied to the web, and comprises according to an embodiment at least two air nozzles for blowing off excess of coating mixture from each web edge region, said air nozzles ejecting air jets which hit the web at a position about 1 to 50 mm, preferably 2 to 10 mm from the web edge, in the case when excess of coating mixture shall be blown off from the web edges when the entire width of the web shall be coated. In the case, when excess of coating mixture existing in strands at a distance from the web edges shall be removed, the air nozzles may be provided further inwards, i.e. at a greater distance from the web edges, and be directed so that the compressed-air jets hit said strands. Also combinations of these two principles can be conceived, i.e. for the removal of excess of coating mixture in the form of strands at a distance from the web edges, as well as excess of coating mixture in the very web edges, wherein air nozzles are provided so that both those types of excess of coating mixture can be removed.

The air jets are directed at an angle $\alpha$ of about 10 to 45° to the side surface of the web with a main direction against the respective outer edge of the web. The two, or more, air nozzles are placed on each side of the web in the region of each web edge and have substantially the same direction, so that the respective air jets hit the web in approximately the same position and at approximately the same angle. In specific cases, and that particularly concerns single-sided coating, however, just one air nozzle provided in connection to each web edge and directed against the coated or uncoated side may be sufficient.

In a special embodiment, the air is heated/is being heated to between 100° C. and 400° C. in order to accomplish a drying of the web edge and therein further counteract the tacking problem.

The nozzles may have various designs. According to the chosen embodiment, the nozzles have a circular outlet opening, but they may also be designed for instance with a longitudinal, slot-shaped outlet opening. In the latter case, the longitudinal, slot-shaped outlet opening is suitably arranged in parallel with or at an angel to the web edge. Also special air nozzles designed in order to reduce the noise level can be conceived. It is also possible on each side of the web material, at a distance inside of each web edge, to provide a series of a plurality of nozzles after one another in the longitudinal direction of the web, wherein each such nozzle may be directed in the same mode or in different directions in order to provide best blowing-off effect.

In addition to the device, which is a specific feature of the invention, the integrated equipment also includes means for applying the coating mixture on the running web. The equipment thus in a conventional manner may comprise a device for coating the running web, preferably a paper web or a paper board web, comprising a support member in the form of for instance a roll or a counter-faced blade, a cooperating dosage member intended to deposit an excess of coating paste or other coating material over the entire width of the web, a coater blade placed downstreams of the dosage member, and means for moving the web. The device of the invention is located downstreams of the last one of those conventional members which are included in the coating equipment, in this case downstreams of the coater blade.

The device of the invention preferably also comprises means for collecting and leading away the coating mixture that has been blown off from the web edge regions. These means may for instance include a collecting funnel placed at a distance, e.g. about 2 to 5 cm, outside of each web edge, the centre of the funnel being located approximately aligned with the web line. The mouth of the funnel may be provided with one or more water spraying nozzles, suitably nozzles of the type that spray flat water jets, intended to form a curtain of water in the mouth of the funnel. The funnel or the like suitably is designed such that the removed coating mixture is caused to pass through the water curtain and be mixed with water as it passes through the water curtain, whereupon the mixture is trapped in the funnel and conveyed to a suitable re-circulation or waste system via a pipe system. In a particularly preferred embodiment the walls of the funnel or corresponding member are cooled, e.g. by cooling water circulating in the walls of the funnel in order to provide a condensation on the surface and therein prevent deposition of coating mixture and to facilitate cleaning of the equipment.

Further characteristic features and aspects of the invention will be apparent from the following description of some preferred embodiments and from the appending claims.

BRIEF DESCRIPTION OF DRAWINGS

In the following description of some preferred embodiments, reference will be made to the accompanying drawings, in which.

DESCRIPTION OF PREFERRED EMBODIMENTS

Figure 1:
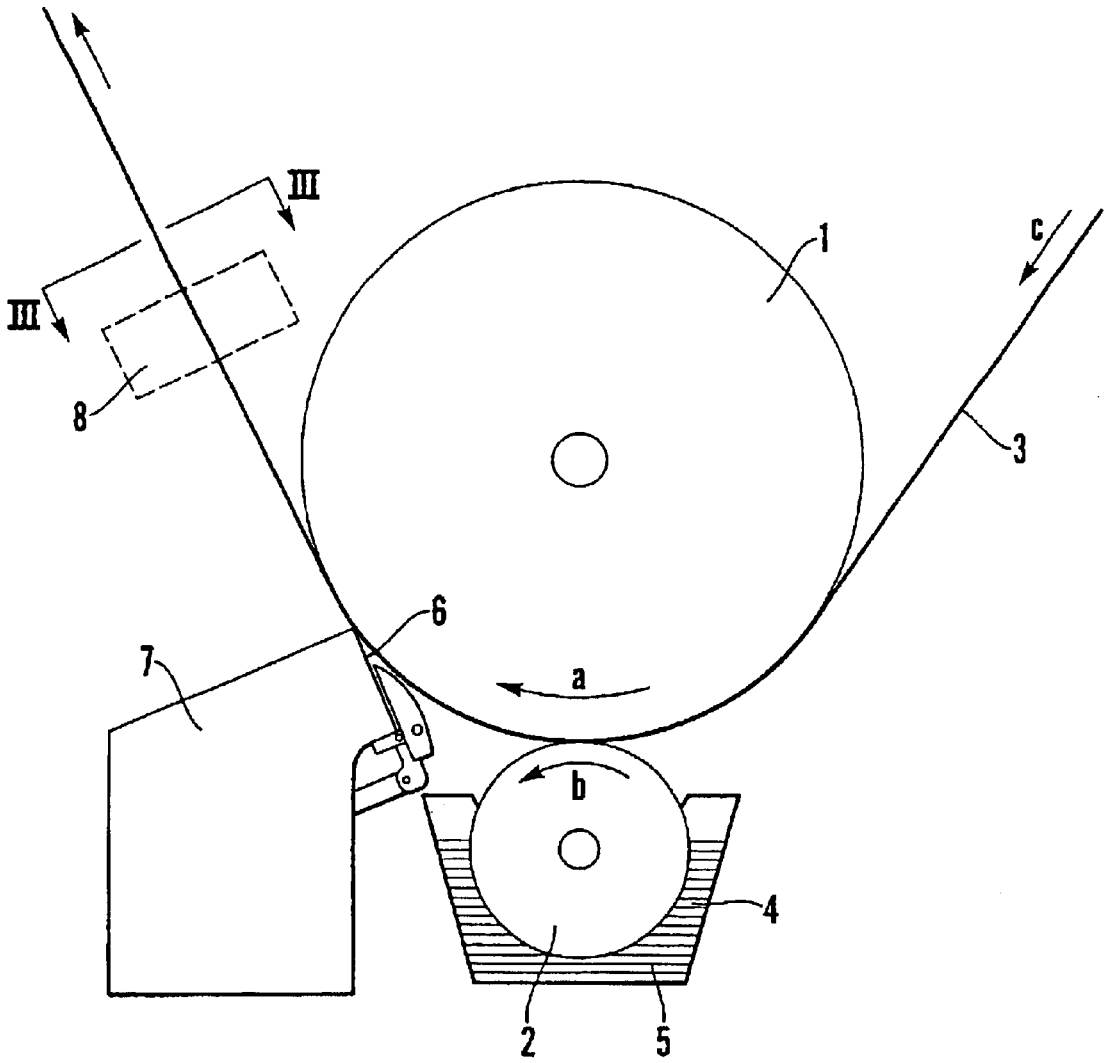
FIG. 1 is a schematic side view of a device for single-sided coating and a device for blowing off excess paste (excess of coating mixture) according to the present invention.

The coating equipment for so-called single-sided coating, which is schematically shown in a side view in FIG. 1, is of a type known per se and comprises a support roll 1, which rotates in the direction of the arrow a; and a dosage roll 2, which rotates in the direction of arrow b, wherein a paper web 3 is moved forwards in the direction of the arrow c. The dosage roll 2 applies a coating mixture in the form of a paste 4 to the paper web 3 from a trough 5. Downstreams of the dosage roll 2 a coater blade 6 is provided, said blade in a conventional mode being held in a blade holder 7. The coater blade 6 provides a final evening of the coating paste which is applied in excess by the dosage roll.

An edge-blow-off device 8 according to the invention is shown only schematically in FIG. 1. The edge-blow-off device 8 is located downstreams of the coater blade 6.

Figure 2:
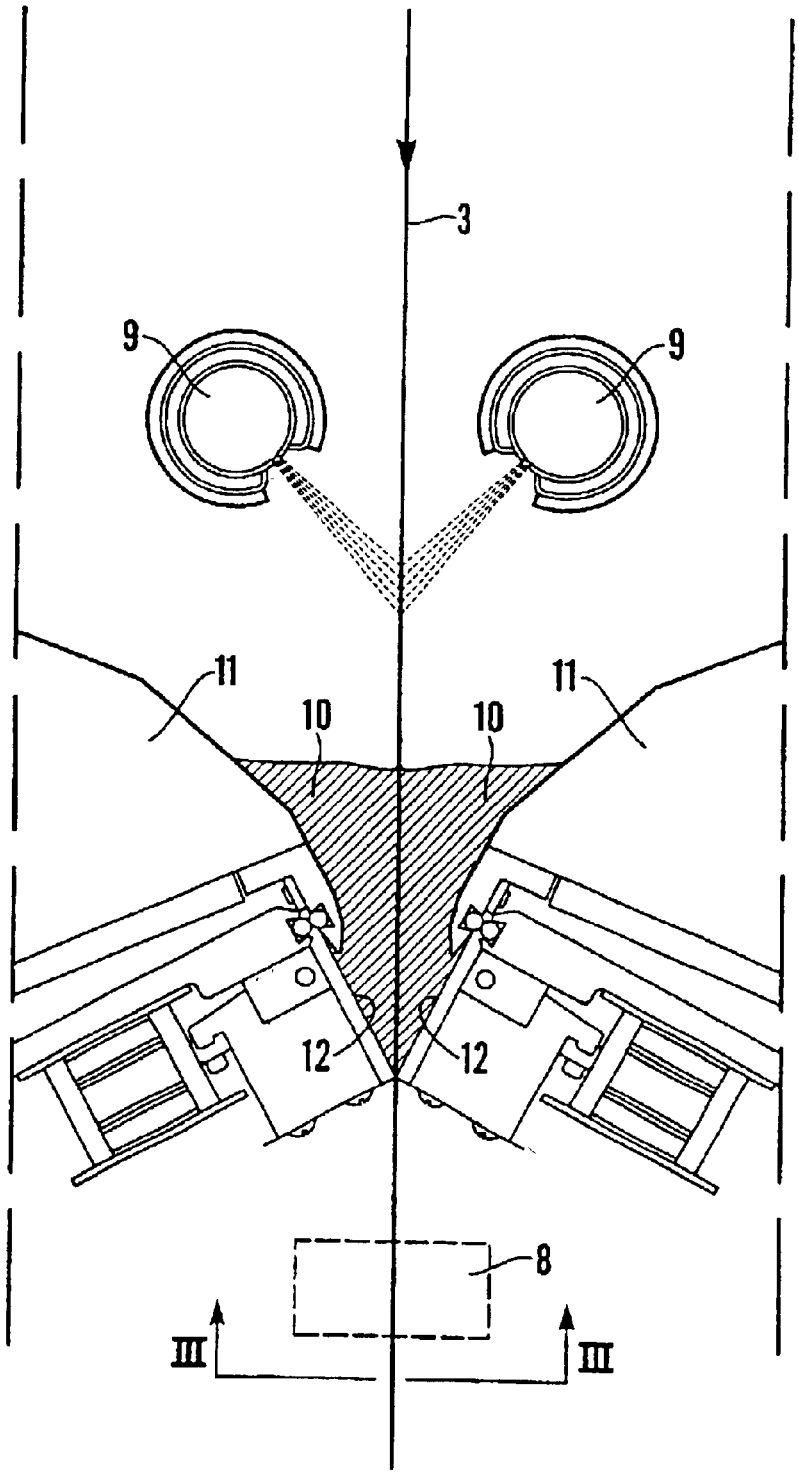
FIG. 2 is a schematic side view of a device for double-sided coating and a device for blowing off coating mixture according to the present invention.

FIG. 2 schematically shows in a side view a coating equipment, which is known in the art through said SE 507 926, for double-sided coating, wherein a paper web 3 is guided vertically downwards through the coating station. The paper web 3 is coated with a coating mixture in the form of a paste by spraying by means of two opposite applicator tubes 9, so-called fountain applicators. On each side of the web 3 there is formed a pond of coating mixture 10 in the V-shaped space which is defined by two blade holders 11 and two coater blades 12.

The edge-blow-off device 8 according to the invention is shown only schematically also in FIG. 2 and is located downstreams of the coater blades 12.

Figure 3:
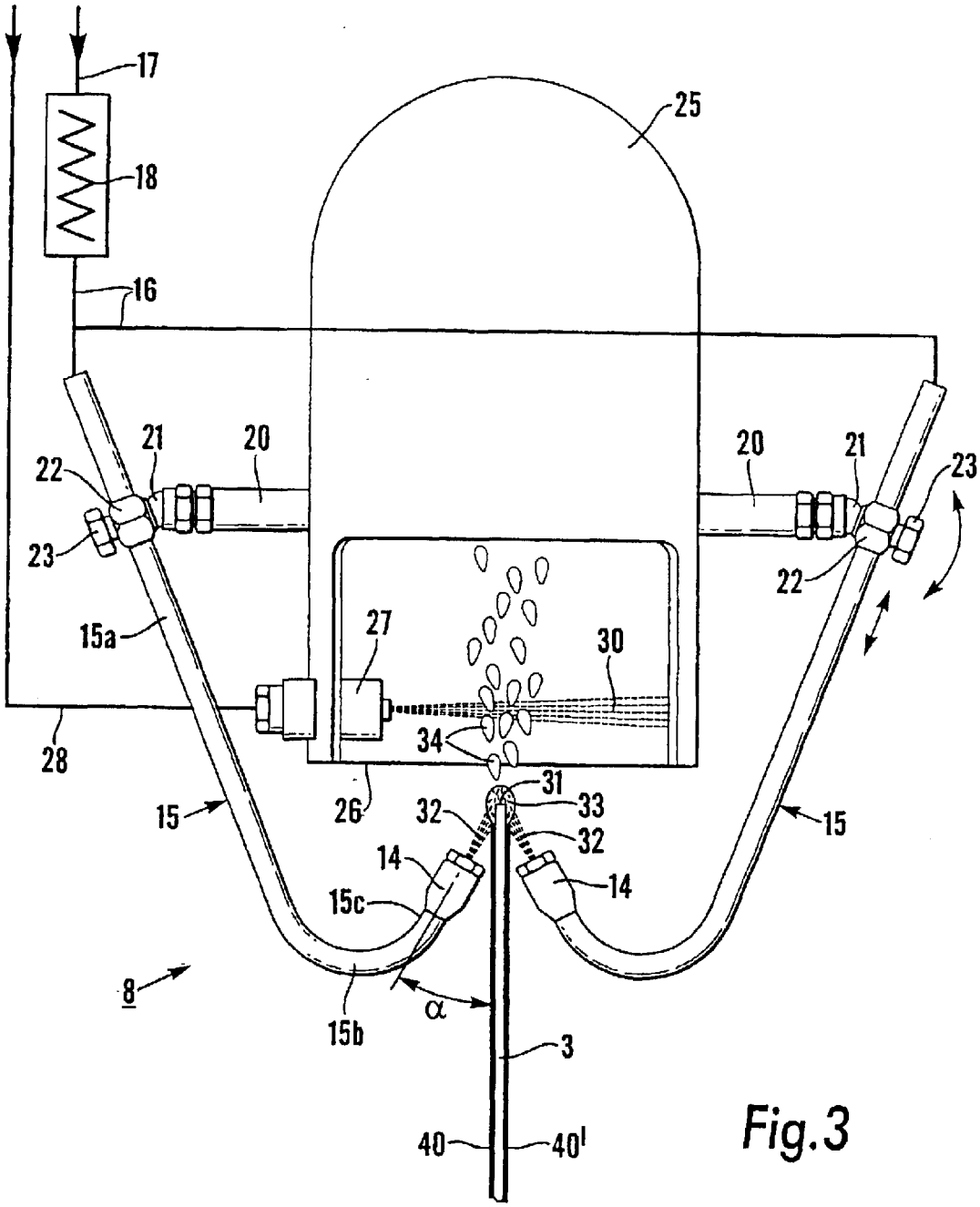
FIG. 3 shows a cross-section through the device of the invention and of the web edge and a portion of the web along the line III—III in FIG. 1 and FIG. 2 according to a first application of the invention for the removal of excess of coating mixture from the web edges in the case of coating of the entire width.

With reference now to FIG. 3, there is shown a web 3, which just has been coated with a coating 40 on at least one side, possibly with a coating 40' also on the other side, corresponding to the embodiments according to FIG. 1 and FIG. 2, respectively.

The device 8 shown in detail in FIG. 3 comprises two air nozzles 14. Said nozzles are mounted on one end of two tubes 15, which are connected with a compressed-air source, not shown, via compressed-air conduits 16, 17. In the conduit 17 there is also provided a pre-heater 18 for any possible pre-heating of the compressed air. The tubes 15 are mounted on brackets 20 via ball-and-socket joints 21, which allow positioning of the tubes 15 and hence of the nozzles 14 at various angles. Each tube 15 has a straight, elongated portion 15*a*; a bend 15*b*, which deflects the tube about 120°; and an end portion 15*c*, on which a nozzle 14 is mounted. The tubes 15 also can be displaced in the longitudinal direction in relation to a tube holder 22, when a fixing screw 23 has been undone, and can thereafter be fixed in a desired position by drawing the screw 23.

The device according to the embodiment of the invention also comprises a receiver, here referred to as a funnel 25, for the excess 33 of coating mixture that is blown off from the web edge region. In the mouth 26 of the funnel 25 there are mounted one or more air nozzles 27, which are connected to a not shown source of pressurized water via a conduit 28. The water nozzle/s 27 according to the embodiment consists/consist of water spraying nozzles of the type that spray flat water jets, which generate one or more water curtains 30 across the mouth section of the collecting funnel 25 at right angle to the plane of the web 3.

The described device 8 functions in the following way. The tubes 15 and hence the nozzles 14 are set in suitable positions through displacement of the tubes 15 in relation to its respective holder 22 and through turning in the ball-and-socket joint 21. Generally, the nozzles 14 are positioned at a short distance from the web 3 inside of the web edge 31. The nozzles 14 are directed at an angle a in the order of 15° to 45° to the plane of the web 3 and outwards towards the web edge 31 and/or towards an edge zone adjacent to the web edge 31. The pressurized-air conduit 17 is connected to the pressure source, wherein the generated pressurized-air jets 32, which flow out through the openings in the nozzles 14, blow off the paste excess (superfluous coating mixture) 33 located at the edge portion of the web. The thus removed surplus of coating mixture form droplets 34, which are blown in through the mouth 26 of the collecting funnel 25. The drops 34 then pass through the water curtain/s 30 and are mixed with the water in said water curtain/s, so that the mixture will get a sufficiently low viscosity in order to be led away without problems from the funnel 25 through a not shown conduit and be recovered.

The device 8, shown in FIG. 3, is arranged in connection to one of the two edges of the web 3. An equivalent device 8 is arranged also in connection to the opposite edge of the web.

EXAMPLE

The example relates to application of the invention for double-sided coating of a running paper web right out to the web edges by means of opposite blades, FIG. 2. At a test, the equipment which has been described with reference to FIG. 3 was employed. At the test, the excess of coating mixture, that was blown off from the edge, and water from the water curtain, which was passed by the blown-off mixture, were collected in a container during a certain period of time. The collected liquid was evaporated and the content of dry matter was measured. The measurements indicated an evident reduction of coating mixture on the edge.

Practical measurements also were made during the test through observation of depositions of coating mixture on the drying cylinders of the machine downstream of the coater assembly. These observations indicated that no deposition of coating mixture on the web edges or on the drying cylinders could be found as long as the air nozzles were connected to the pressurized-air source, but as soon as the flow of compressed air was shut off, generation of depositions of coating mixture at the web edges immediately started. For the above described test the following parameters apply:

- Surface weight of web: 250 g/m$^2$ (including coating mixture)
- Deposited coating material: 15 g/m$^2$/side
- Web speed: 250 m/min
- Dry content of coating material: 60%
- Blowing angle $\alpha$ (FIG. 3): 30°
- Blowing distance (distance of nozzle openings from the web): 30 mm
- Blowing-off width; 3 mm, i.e. the distance from the point of hit of the air jet to the edge
- Consumption of air: 14 m$^2$/h×2
- Blown-off quantity of coating mixture: 0.5 g/min or 7 g/m$^2$ treated surface.

Figure 4:
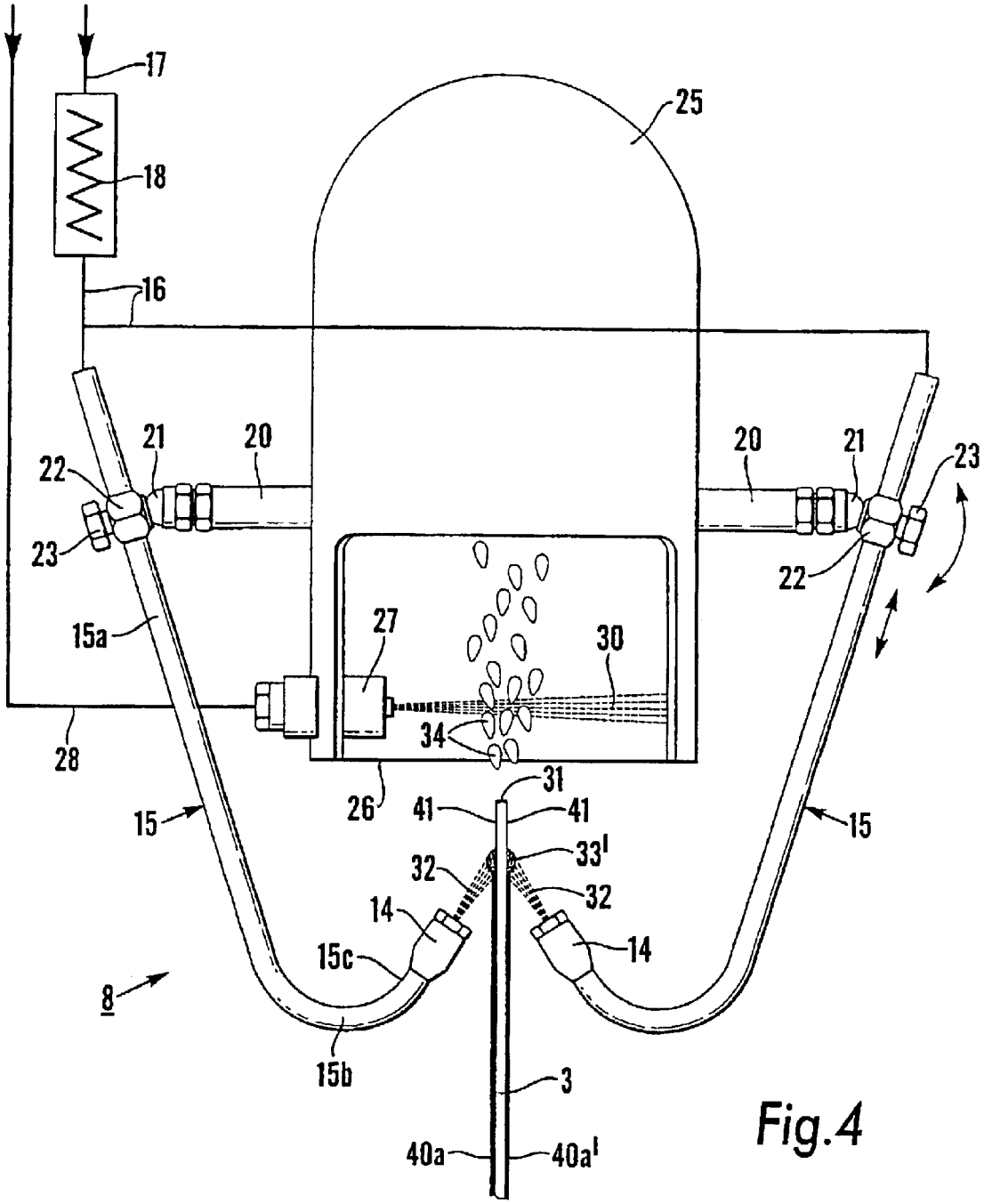
FIG. 4 illustrates a second application of the invention for the removal of excess of coating mixture in the form of strands at a short distance from the web edges.

At the application according to FIG. 4, excess paste 33' in the form of strands in the border zones between the coated 40*a*, 40*a*' and uncoated portions 41 on both sides of the web, which were formed because of heavy wear of the coater blades, was blown off. In this application, the nozzles 14 are located at a longer distance from the edges 31 and are directed against the strands 33' and/or against a point immediately inside the strands, so that the compressed-air jets 32 hit the strands 33' directly and/or are guided towards the strands when they have hit the web. The strands 33' herein will partly be distributed by the compressed-air jets out over the dry edge portions 41, and partly be blown off and be collected in the collecting funnel 25. This makes an improved drying possible, which reduces the problems concerning depositions on guide rolls and drying cylinders.

What is claimed is:

1. A method for coating a running paper web or a paper board web with a liquid coating mixture, comprising the steps of:

providing a means for moving the paper web or paper board web;

providing a dosage member for depositing a coating paste or other coating material over the entire width of the web;

providing a coater blade downstream of said dosage member, so that at least one side of the web is provided with a coating of a coating mixture;

providing a blowing-off device downstream of where the coating is performed, which blowing-off device only removes existing excess of coating mixture in or adjacent to regions of at least one edge portion of the paper web or paper board web; and collecting blown-off excess coating mixture in a collecting member provided outside the web edge.

2. A method according to claim 1 wherein excess of coating mixture is blown off by compressed air from one or more compressed-air jets while the coating mixture is in a liquid state.

3. A method according to claim 2, wherein the compressed air is pre-heated in order to cause evaporation of coating mixture.

4. A method according to claim 2, wherein the compressed-air jet is directed at an acute angle in relation to the surface of the web and outwards towards the web edge from a position inside of the web edge or towards a region inside the web edge from a position which is at a distance further inside the web edge.

5. A method according to claim 4, wherein the compressed-air jet is directed at an acute angle in relation to the surface of the web and outwards towards the web edge from a position inside of the web edge for the removal of excess of coating mixture on and adjacent to the web edge.

6. A method according to claim 4, wherein the compressed-air jet is directed at an acute angle in relation to the surface of the web and outwards towards a region inside the web edge from a position at a distance further inside the web edge for the removal of excess of coating mixture from said region inside the web edge.

7. A method according to claim 1, wherein blown-off excess coating mixture is caused to pass through one or more water curtains and to be mixed with water in said curtain/s along its pathway towards said collecting member.

8. A method for coating a running paper web or a paper board web with a liquid coating mixture, comprising the steps of:

providing a means for moving the paper web or paper board web;

providing a dosage member for depositing a coating paste or other coating material over the entire width of the web;

providing a coater blade downstream of the dosage member so that at least one side of the web is provided with a coating of a coating mixture;

providing a blowing-off device downstream of where the coating is performed, which blowing-off device only removes existing excess of coating mixture in or adjacent to the regions of at least one edge portion of the paper web or paper board web; and providing at least one nozzle on each side of the web near the at least one web edge.

* * * * *